US010935329B2

(12) United States Patent
Hanlon et al.

(10) Patent No.: US 10,935,329 B2
(45) Date of Patent: Mar. 2, 2021

(54) HEAT EXCHANGER WITH HEATER INSERT

(71) Applicant: Hussmann Corporation, Bridgeton, MO (US)

(72) Inventors: Sean M. Hanlon, O'Fallon, MO (US); Tobey D. Fowler, Maryland Heights, MO (US)

(73) Assignee: Hussmann Corporation, Bridgeton, MO (US)

( * ) Notice: Subject to any disclaimer, the term of this patent is extended or adjusted under 35 U.S.C. 154(b) by 1365 days.

(21) Appl. No.: 14/599,919

(22) Filed: Jan. 19, 2015

(65) Prior Publication Data

US 2016/0209125 A1 Jul. 21, 2016

(51) Int. Cl.

| | |
|---|---|
| ***F28F 1/12*** | (2006.01) |
| ***F28F 1/32*** | (2006.01) |
| ***F28D 1/047*** | (2006.01) |
| ***F28F 19/00*** | (2006.01) |
| *F28D 21/00* | (2006.01) |

(52) U.S. Cl.

CPC ..... *F28F 1/32* (2013.01); *F28D 1/0477* (2013.01); *F28F 19/006* (2013.01); *F28D 2021/0071* (2013.01)

(58) Field of Classification Search

CPC ..... F28F 19/00; F28F 19/006; F28D 1/047; F28D 1/0447; F25D 21/08; F25D 21/06; F25B 39/02

USPC ..... 219/201

See application file for complete search history.

(56) References Cited

U.S. PATENT DOCUMENTS

| | | | | |
|---|---|---|---|---|
| 3,436,931 | A * | 4/1969 | Gelbard | F25D 21/08 62/276 |
| 3,786,227 | A | 1/1974 | Seipp et al. | |
| 4,369,350 | A * | 1/1983 | Kobayashi | F25D 21/08 219/201 |
| 4,756,358 | A | 7/1988 | O'Neal | |
| 5,186,022 | A | 2/1993 | Kim | |
| 5,765,384 | A | 6/1998 | Carlstedt et al. | |
| 6,230,511 | B1 | 5/2001 | Lee et al. | |
| 6,626,004 | B2 | 9/2003 | Lee | |
| 6,964,172 | B2 | 11/2005 | Dudley et al. | |
| 7,185,502 | B2 | 3/2007 | Park et al. | |
| 7,712,327 | B2 | 5/2010 | Nelson et al. | |
| 7,716,936 | B2 | 5/2010 | Bailey et al. | |
| 8,087,261 | B2 | 1/2012 | Lee et al. | |
| 8,584,476 | B2 | 11/2013 | Kim et al. | |
| 2004/0194491 | A1 | 10/2004 | Park et al. | |
| 2005/0183427 | A1 | 8/2005 | Dudley et al. | |
| 2008/0229763 | A1 | 9/2008 | Nelson et al. | |

(Continued)

FOREIGN PATENT DOCUMENTS

| | | | |
|---|---|---|---|
| RU | 2072488 | C1 * | 1/1997 |
| RU | 2072488 | C1 * | 1/1997 |

*Primary Examiner* — Travis C Ruby
*Assistant Examiner* — Harry E Arant
(74) *Attorney, Agent, or Firm* — Michael Best & Friedrich LLP

(57) ABSTRACT

A heat exchanger includes fins that are spaced apart from each other, and that each include one or more tube slots. A coil is coupled to the fins and includes a tube section extending through axially aligned tube slots. A heater insert extends through one or more of the axially aligned tube slots adjacent an exterior of the tube section to defrost the heat exchanger.

15 Claims, 10 Drawing Sheets

(56) References Cited

U.S. PATENT DOCUMENTS

| | | | | |
|---|---|---|---|---|
| 2010/0192599 | A1 | 8/2010 | Kim et al. | |
| 2010/0251735 | A1 | 10/2010 | Sim et al. | |
| 2011/0138834 | A1 | 6/2011 | Maeda | |
| 2012/0017630 | A1* | 1/2012 | Okabe | B05B 5/16 62/407 |
| 2013/0042638 | A1 | 2/2013 | Eom et al. | |
| 2013/0086929 | A1 | 4/2013 | Senf, Jr. | |

* cited by examiner

HEAT EXCHANGER WITH HEATER INSERT

BACKGROUND

The present invention relates to a heat exchanger, and more particularly, to defrosting the heat exchanger using a heater insert.

Refrigeration systems are well known and widely used in supermarkets and warehouses to refrigerate food product displayed in a product display area of a refrigerated merchandiser or display case. Conventional refrigeration systems include an evaporator, a compressor, and a condenser. The evaporator allows heat transfer between a refrigerant and a fluid passing over coils of the evaporator. The evaporator transfers heat from the fluid to the refrigerant so that the fluid cools the product display area. The refrigerant absorbs heat from the fluid in a refrigeration mode. In the refrigeration mode, the compressor mechanically compresses the evaporated refrigerant from the evaporator and feeds the superheated refrigerant to the condenser, which cools the refrigerant. From the condenser, the cooled refrigerant is fed through one or more expansion valves to reduce the temperature and pressure of the refrigerant, and then the refrigerant is directed through the evaporator.

Since most evaporators in a merchandiser operate at evaporating refrigerant temperatures that are near or lower than the freezing point of water (i.e., 32 degrees Fahrenheit), water vapor from the fluid freezes on the evaporator coils and creates frost. The frost decreases the efficiency of the heat transfer between the evaporator and the fluid (often the fluid is air in a merchandiser), which causes the temperature of the refrigerated space to increase above a desired level. Maintaining the correct temperature of the refrigerated space is important to maintain the quality of the stored food products. To do this, the evaporators must be defrosted regularly in order to reestablish efficiency and proper operation. Conventional methods of defrosting are highly inefficient due to the majority of heat being transferred by convection.

Some existing refrigeration systems defrost the evaporator using convection (a heating element that heats the air), which melts the frost over a period of time. This method often results in wasted heat because some of the heated fluid escapes into the product display area, potentially spoiling the food product.

Other conventional refrigeration systems include valves that direct superheated vapor from a discharge line of the compressor into the evaporator to defrost the coils (commonly referred to as "hot gas" defrost). However, the process increases energy costs necessitated by operation of the compressors that compress the superheated vapor. Other conventional refrigeration systems use a process called "reverse gas" defrost where refrigerant is directed through the evaporator in a direction opposite refrigerant flow during normal refrigeration mode operation. However, returning the refrigerant to the system can be disruptive to normal operation of the system.

SUMMARY

In one construction, the invention provides a heat exchanger comprising of fins that are spaced apart from each other, and that each include one or more tube slots. A coil is coupled to the fins and includes a tube section extending through axially aligned tube slots. A heat insert extends through one or more of the axially aligned tube slots adjacent an exterior of the tube section to defrost the heat exchanger.

In another construction, the invention provides a heater insert for defrosting a heat exchanger including fins and a coil with tube sections extending through tube slots within the fins. The heater insert includes a body elongated along an axis, and pleats disposed and oriented on the elongated body to contact one or more of the fins upon installation of the heater insert in the heat exchanger.

In another construction, the invention provides a heat exchanger comprising of fins that are spaced apart from each other, and that each include one or more tube slots. A coil is coupled to the fins and includes a tube section extending through axially aligned tube slots. A heater insert includes an elongated body extending through the axially aligned tube slots. The heater insert is in contact with one or both of the fins and an exterior surface of the tube section to conductively heat the one or both of the fins and the exterior surface.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
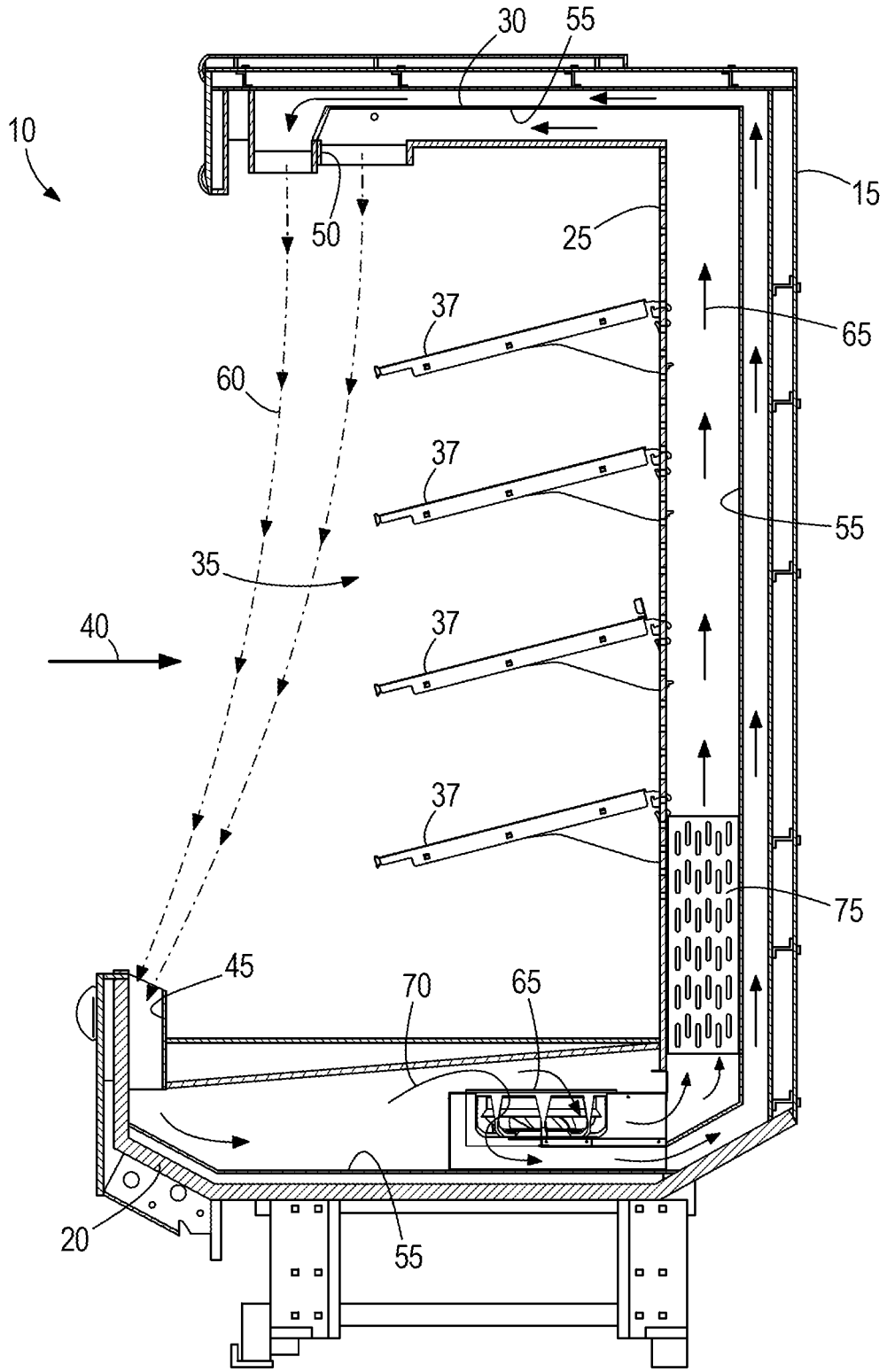
FIG. 1 is a section view of a refrigerated merchandiser including an evaporator embodying the present invention.

FIG. 1 illustrates an exemplary refrigerated merchandiser 10 that may be located in a supermarket or a convenience store or other retail setting (not shown) for presenting fresh food, beverages, and other product (not shown). As shown, the merchandiser 10 is an upright merchandiser with an open front. The merchandiser 10 can be an upright merchandiser that is provided with or without doors, a horizontal merchandiser with an open or enclosed top, or another type of merchandiser.

The illustrated merchandiser 10 includes a case 15 that has a base 20, a rear wall 25, and a canopy 30. The area partially enclosed by the base 20, the rear wall 25, and the canopy 30 defines a product display area 35 that stores food product in the case 15 (e.g., on shelves 37) and that is accessible by customers through an opening 40 adjacent the front of the case 15. The base 20 includes an air inlet 45 located adjacent a lower portion of the opening 40 and an air outlet 50 that is positioned in the canopy 30. The case 15 defines an air passageway 55 that provides fluid communication between the air inlet 45 and an air outlet 50 to direct a refrigerated airflow across the product display area 35 in the form of an air curtain 60. A fan 65 is coupled to the case 15 to generate an airflow (denoted by arrows 70) within the air passageway 55.

With continued reference to FIG. 1, the merchandiser 10 includes a refrigeration system (not entirely shown) that circulates a heat transfer fluid (e.g., refrigerant, coolant, etc.) to refrigerate product supported in the product display area 35. More specifically, the refrigeration system includes a heat exchanger or evaporator 75 (referred to herein as an "evaporator" for purposes of description only) that is fluidly coupled with a compressor to deliver evaporated refrigerant from the evaporator 75 to the compressor, and is fluidly coupled with a condenser to receive cooled, condensed refrigerant from the condenser. The evaporator 75 is disposed in the passageway 55 and, in operation, refrigerant in the evaporator 75 absorbs heat from the airflow 70 within the passageway 55 to decrease the temperature of the airflow 70 passing over the evaporator 75. The heated or gaseous refrigerant then exits the evaporator 75 and is directed to the compressor. The cooled or refrigerated airflow 70 exiting the evaporator 75 is directed toward the product display area 35 via the passageway 55 and the outlet 50 to maintain product in the product display area 35 at desired conditions.

Figure 2:
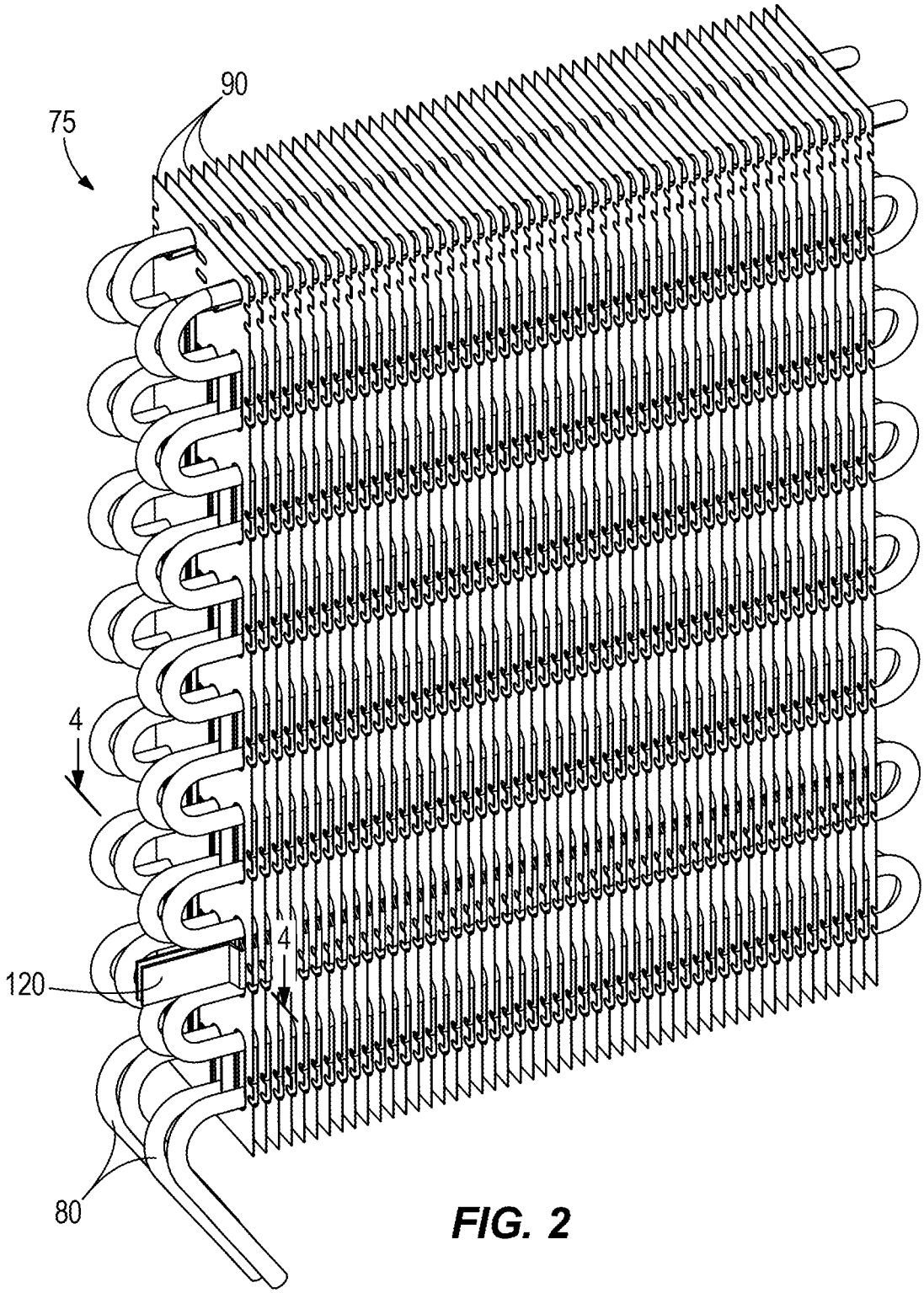
FIG. 2 is a perspective view of the evaporator of FIG. 1 including a coil assembly having coils and fins, and an exemplary heater insert coupled to the coil assembly.
Figure 3:
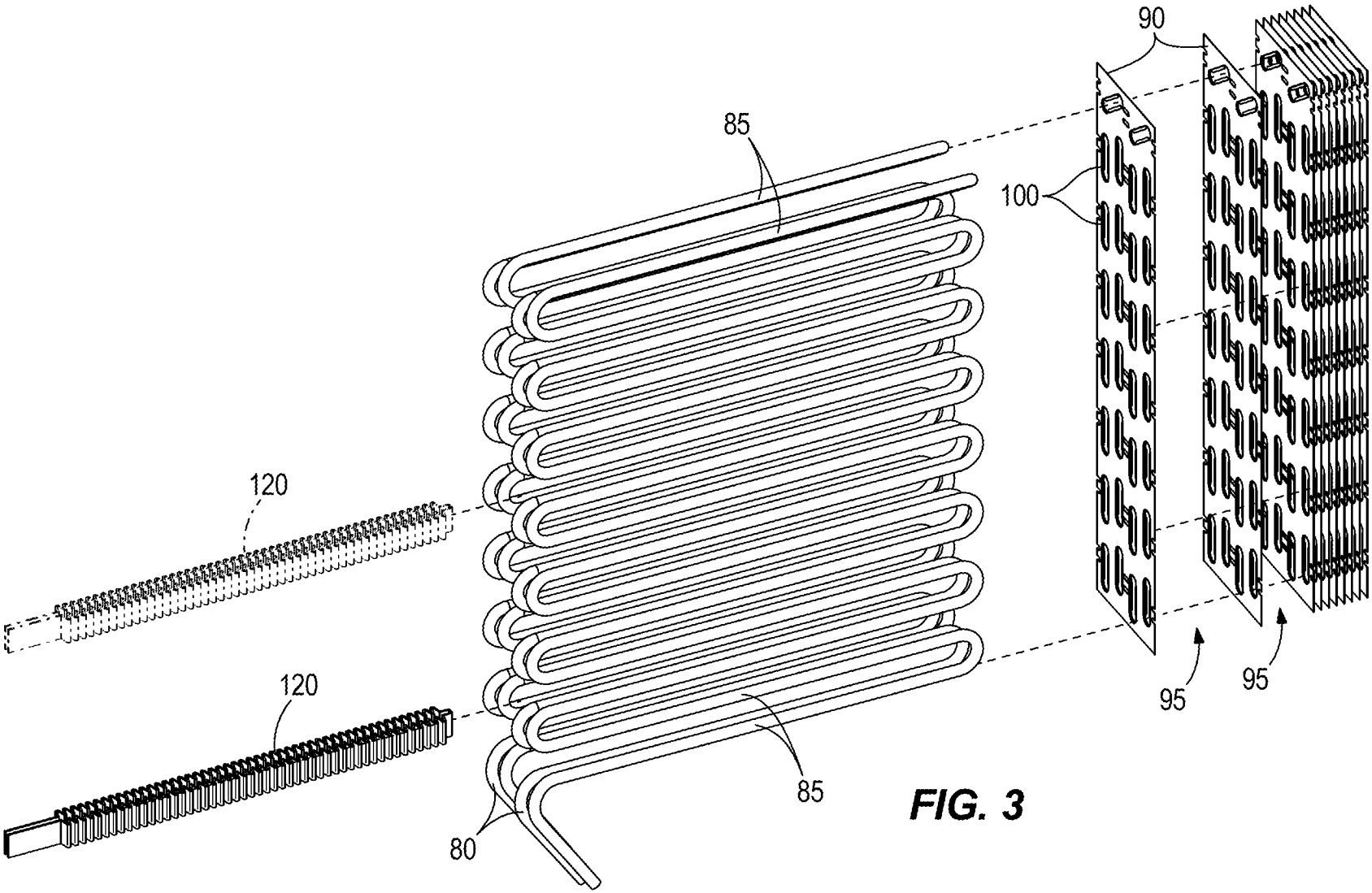
FIG. 3 is an exploded perspective view of the evaporator of FIG. 2 illustrating the coils, the fins, and the heater insert.

With reference to FIGS. 2 and 3, the illustrated evaporator 75 includes a serpentine coil assembly that has two coils 80 with tube sections 85 extending through a plurality of fins 90. The quantity of coils 80 in the evaporator can vary (e.g., the coil assembly can have one coil 80 or two or more coils 80). Refrigerant or coolant from the refrigeration system flows through the coils 80 and heat is absorbed from the airflow 70.

Figure 8:
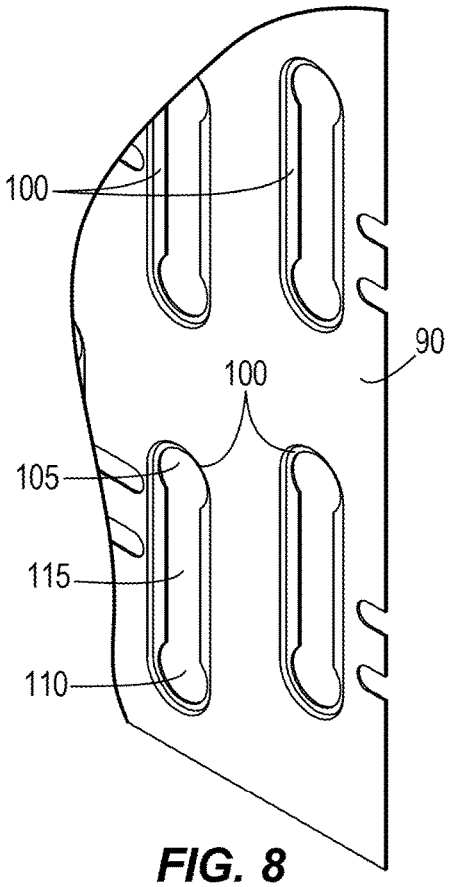
FIG. 8 is an enlarged view of the slots on a fin.
Figure 10:
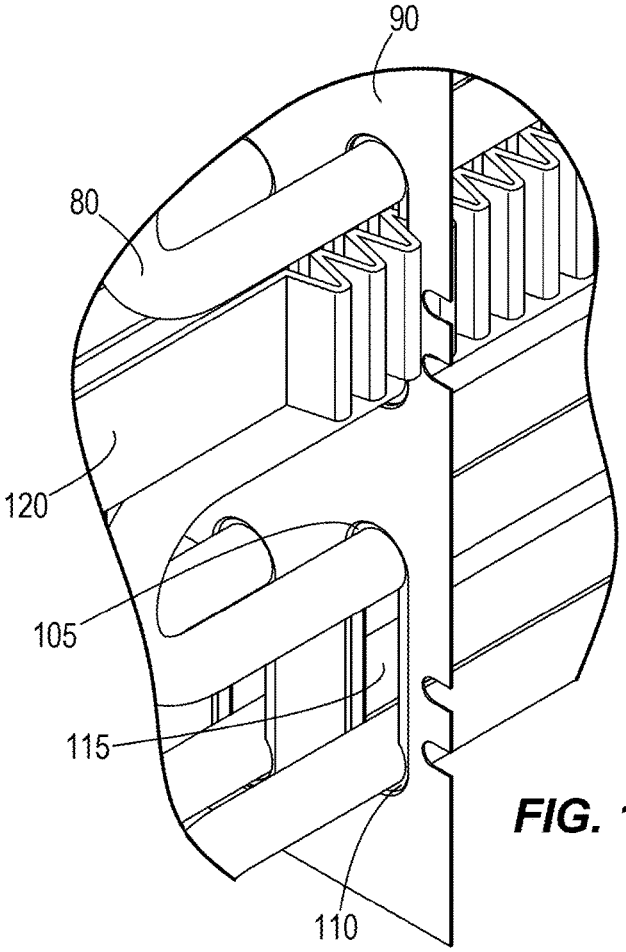
FIG. 10 is an enlarged view of the slots in FIG. 8 illustrating the coils and another exemplary heater insert.

Referring to FIGS. 2 and 3, the fins 90 are spaced apart from each other by a distance (e.g., a common distance or different distances), forming air gaps 95 between adjacent fins 90. Each fin 90 is defined by a plate structure and includes slots 100 (commonly referred to as "dog bone" slots). As shown in FIG. 8, each slot 100 has a first tube orifice 105 and a second tube orifice 110 spaced from the first tube orifice by an elongated aperture 115. The horizontal and/or vertical spacing between the tube sections 85 can be modified, and other tube patterns also can be incorporated into the evaporator 75 (e.g., inline, staggered, angled, etc.). The size and shape of the slots 100 can vary in order to accommodate different tube patterns.

FIGS. 2-4E illustrate an exemplary heater element or heater insert 120 (referred to as a "heater insert" for purposes of description) that is coupled to the evaporator 75 to facilitate defrost. It will be appreciated that the evaporator 75 can include one or more heater inserts 120 depending on design characteristics of the evaporator 75 and other factors (e.g., amount of defrost needed, etc.). Also, the quantity and position of the heater inserts 120 can conform to a predefined pattern that is determined by a projected frost profile for the evaporator 75.

The illustrated heater insert 120 is an electrically resistive heater element that is formed of a suitable material (e.g., carbon fiber, metal, etc.) that can be bent or formed into shape. Power can be provided to the heater insert 120 via electrical connections 125. Although the electrical connections 125 are illustrated on the same end of the heater insert 120, the connections 125 can be located on opposite ends or between the ends of the heater insert 120.

The heater insert 120 is engaged with the fins 90 via the slots 100 and extends generally parallel to the tube sections 85. The illustrated heater insert 120 spans the entire length of the evaporator 75 and is defined by an elongated body 130 that has extension portions 135 connected to each other by an end or bridge 140 (e.g., to form a U-shaped elongated body 130). Although the heater insert 120 shown in FIGS. 3-4E has two extension portions 135, it will be appreciated that the heater insert 120 can have a single extension portion 135. Also, it will be appreciated that the heater insert 120 can span less than the entire length of the evaporator 75.

Figure 4A:
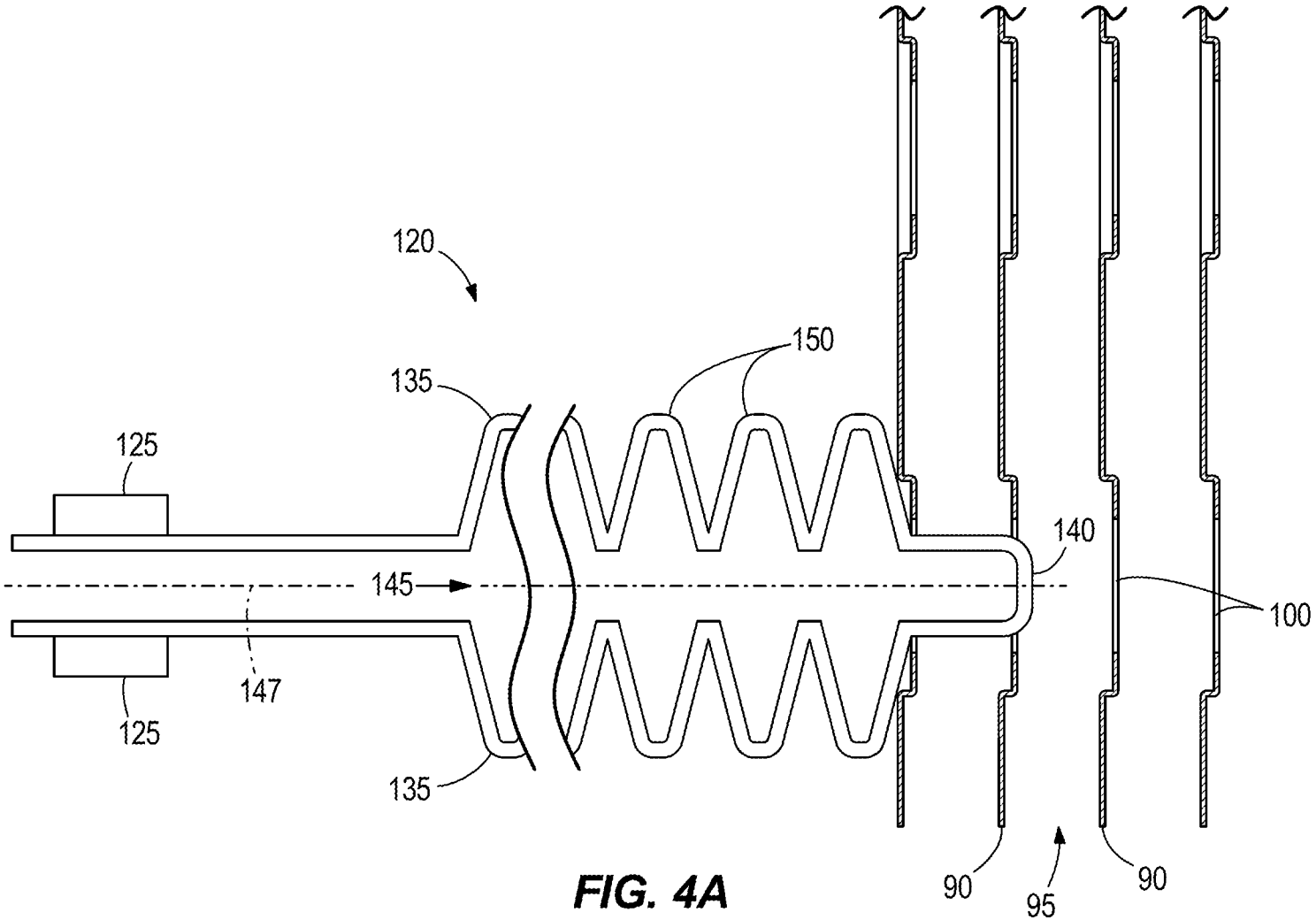
FIGS. 4A-E are sides views of a portion of the evaporator of FIGS. 2 and 3 illustrating the relationship between the heater insert and the fins as the heater insert is positioned in the evaporator.
Figures 4B, 4C, 4D:
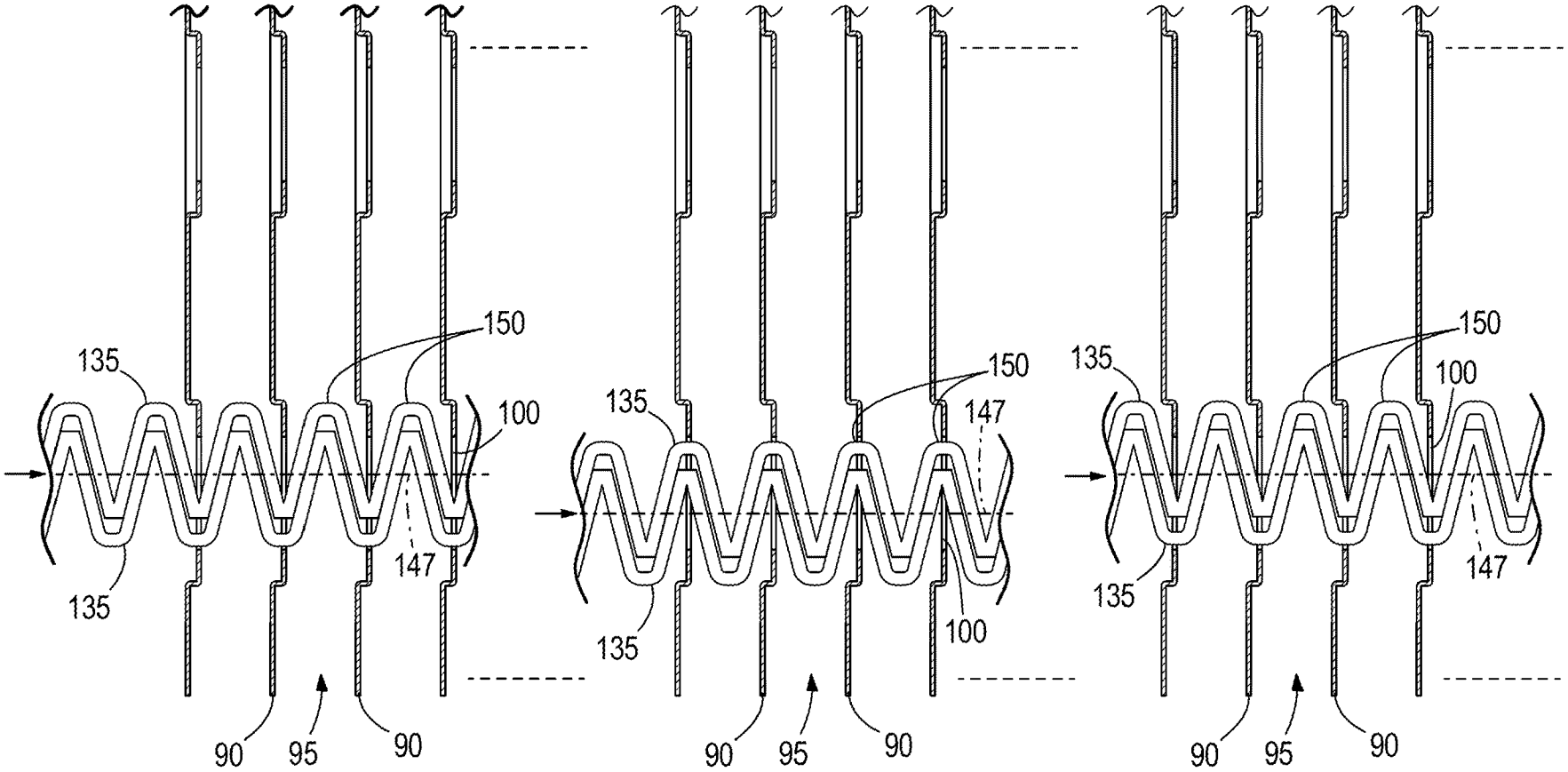
Figure 4E:
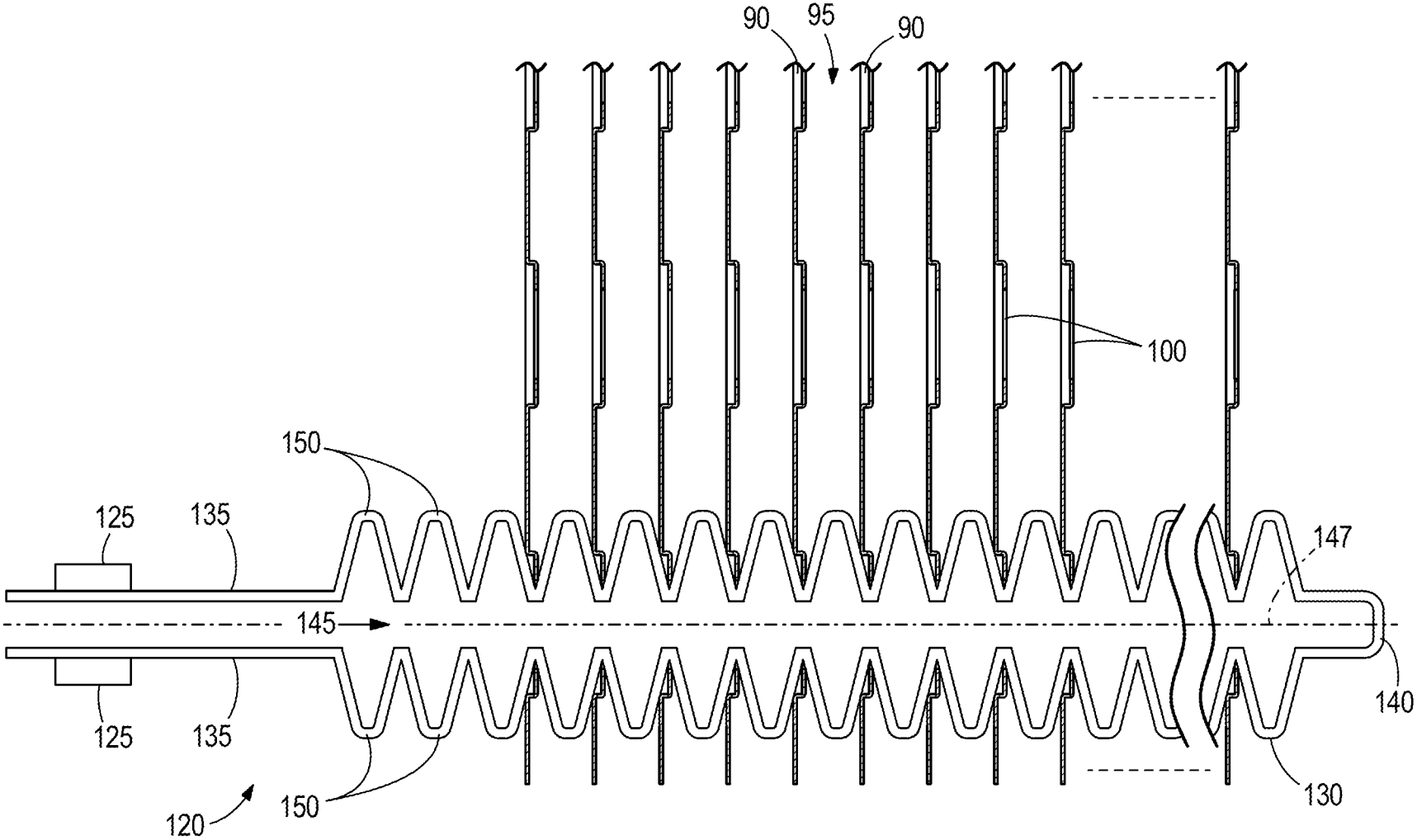

As shown in FIGS. 4A and 4E, the extension portions 135 are spaced apart from each other by a gap 145 that is aligned with an airflow direction associated with the fins 90 so that air can flow through the heater insert 120. The illustrated extension portions 135 are symmetrical about an axis 147 extending along the length of the heater insert 120, although the extension portions 135 can be non-symmetrically arranged. With continued reference to FIGS. 4A-4E, the extension portions 135 are bent or formed to have a generally sinusoidal configuration. More specifically, each extension portion 135 has pleats 150 that are disposed along and oriented on the elongated body 130 to contact or engage one or more of the fins upon installation into the evaporator 75. Although the heater insert 120 has pleats 150 on both extension portions 135, it will be appreciated that only one of the extension portions 135 can have pleats 150 while remaining consistent with the scope of the invention.

With reference to FIG. 4E, the pleats 150 are uniformly spaced so that a single pleat 150 protrudes into each air gap 95 between adjacent fins 90. As will be appreciated, the pleats 150 (and the shape of the extension portions 135 more generally) can take other forms (e.g., non-uniform spacing, etc.) that facilitate contact with one or both of the tube sections 85 and the fins 90. Also, while each illustrated extension portion 135 has the same quantity of pleats 150 relative to air gaps 95, it will be understood that the heater insert 120 can have fewer pleats 150 than the quantity of air gaps 95 between fins 90 (e.g., some fins 90 may not be engaged by pleats 150).

Generally, the evaporator 75 is assembled by sequentially passing each fin 90 over the coils 80 so that the tube sections 85 extend through axially-aligned slots 100. The fins 90 are spaced a small distance apart from each other (e.g., using spacers, not shown) so that air can pass between the gaps 95 and along surfaces of the fins 90. The heater insert 120 can then be guided through the axially-aligned slots 100 to engage one or both of the tube section 85 and the fins 90. Referring to FIGS. 3 and 4A-4E, the heater insert 120 can be installed in or coupled to the evaporator 75 before or after the evaporator 75 is fully assembled (e.g., during or after assembly). Although assembly of the evaporator 75 is described in detail below with regard to the heater insert 120 being installed after assembly of the coil(s) 80 and the fins 90, it will be appreciated that the order of assembly can vary depending on circumstances (e.g., original manufacture, after-market installation, etc.).

The extension portions 135 resiliently flex toward and a way from each other so that the heater insert 120 can fit through the slots 100. With reference to FIG. 4A, the bridge 140 is positioned in the tube slots 100 of the outermost fins 90 so that the first pleat(s) 150 are close to or in contact with the outermost fin 90. At this point, the extension portions 135 are biased toward each other (e.g., pinched together along the body 130) to minimize the space 145 between the extension portions 135. As illustrated in FIGS. 4B-4D, one or both of the resilient extension portions 135 can move or flex in a direction along the axis 147 (e.g., one extension portion 135 can move toward the left in FIG. 4A by pulling on the portion 135, and the other extension portion 135 can remain stationary or move to the right in FIG. 4A). One or both of the extension portions 135 further resiliently flexes toward and away from the axis 147 so that the body 130 can fit through the slots 100. That is, the extension portions 135 are flexed so that the troughs of pleats 150 on one extension portion 135 (e.g., the upper extension portion as viewed in FIGS. 4B-4D) are disposed in (e.g., nested) in the troughs of pleats 150 on the other extension portion 135 (e.g., the lower extension portion as viewed in FIGS. 4B-4D). Likewise, the peaks of pleats 150 on one extension portion 135 (e.g., the lower extension portion as viewed in FIGS. 4B-4D) are disposed in (e.g., nested) in the peaks of pleats 150 on the other extension portion 135 (e.g., the upper extension portion as viewed in FIGS. 4B-4D).

Stated another way, the heater insert 120 is 'walked-through' the fins 90 by aligning (nesting) the peaks and troughs of the pleats 150 with each other and flexing the extension portions 135 toward each other (e.g., to nest the pleats 15) to minimize the width of the heater insert 120, and then inserting the heater insert 120 through the tube slots 100 such that the periphery or edges of the tube slots 100 defined by the fins 90 follow the contour of the extension portions 135. FIGS. 4B-4D show one cycle of the installation process during which the pleats 150 on each extension portion 135 are sequentially maneuvered or weaved through the tube slots 100. FIG. 4B illustrates the lower edge of the tube slots 100 following the contour of the pleats 150 on the lower extension portion 135 so that those pleats 150 can pass through the tube slots 100. FIG. 4C illustrates the upper edge of the tube slots 100 following the contour of the pleats 150 on the upper extension portion 135 so that those pleats 150 can pass through the tube slots 100. FIG. 4D illustrates the upper edge of the tube slots 100 again following the contour of the pleats 150 on the upper extension portion 135.

After weaving the heater insert 120 through the slots 100, the bias applied to the extension portions 135 (along and across the axis 147) can be released so that the pleats 150 on each extension portion 135 are fully positioned in the corresponding gaps 95. In general, releasing the bias across the axis 147 will self-correct the bias along the axis 147 due to the positions of the troughs on the lower side and the peaks on the upper side relative to the location of the fins 90. Release of the bias returns the heater insert 120 to its original shape or close to the original shape.

It will be appreciated that the heater insert 120 can be installed within the evaporator 75 in other ways. For example, the pleats 150 can each bend at an angle (e.g., roughly 90 degrees) until the pleats 150 are able to pass through the slots 100 in the fins 90. Alternatively, the pleats 150 can flex into a flattened shaped as they pass each fin 90, and then the pleats 150 can flex back into their original shape when they enter the air gap 95. If more than one heater insert 120 is utilized, the heater inserts can be connected to each other so that the inserts 120 can be slid into the evaporator 75 simultaneously. The heater insert 120 can be removed (and replaced by another heater insert, if desired) by reversing the steps described above.

Figure 5:
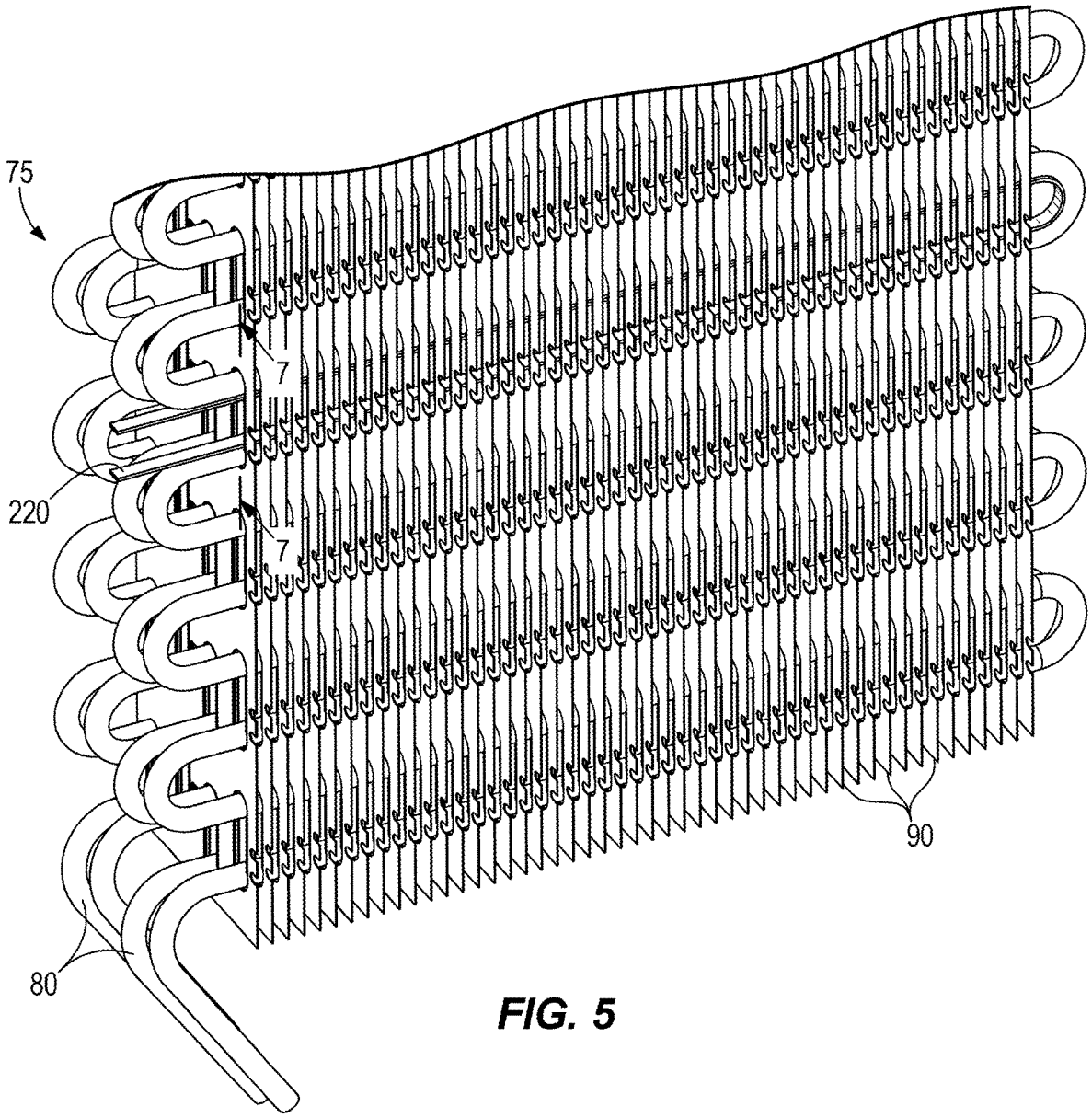
FIG. 5 is a perspective view of a portion of the evaporator of FIG. 1 including the coil assembly and another exemplary heater insert.
Figure 6:
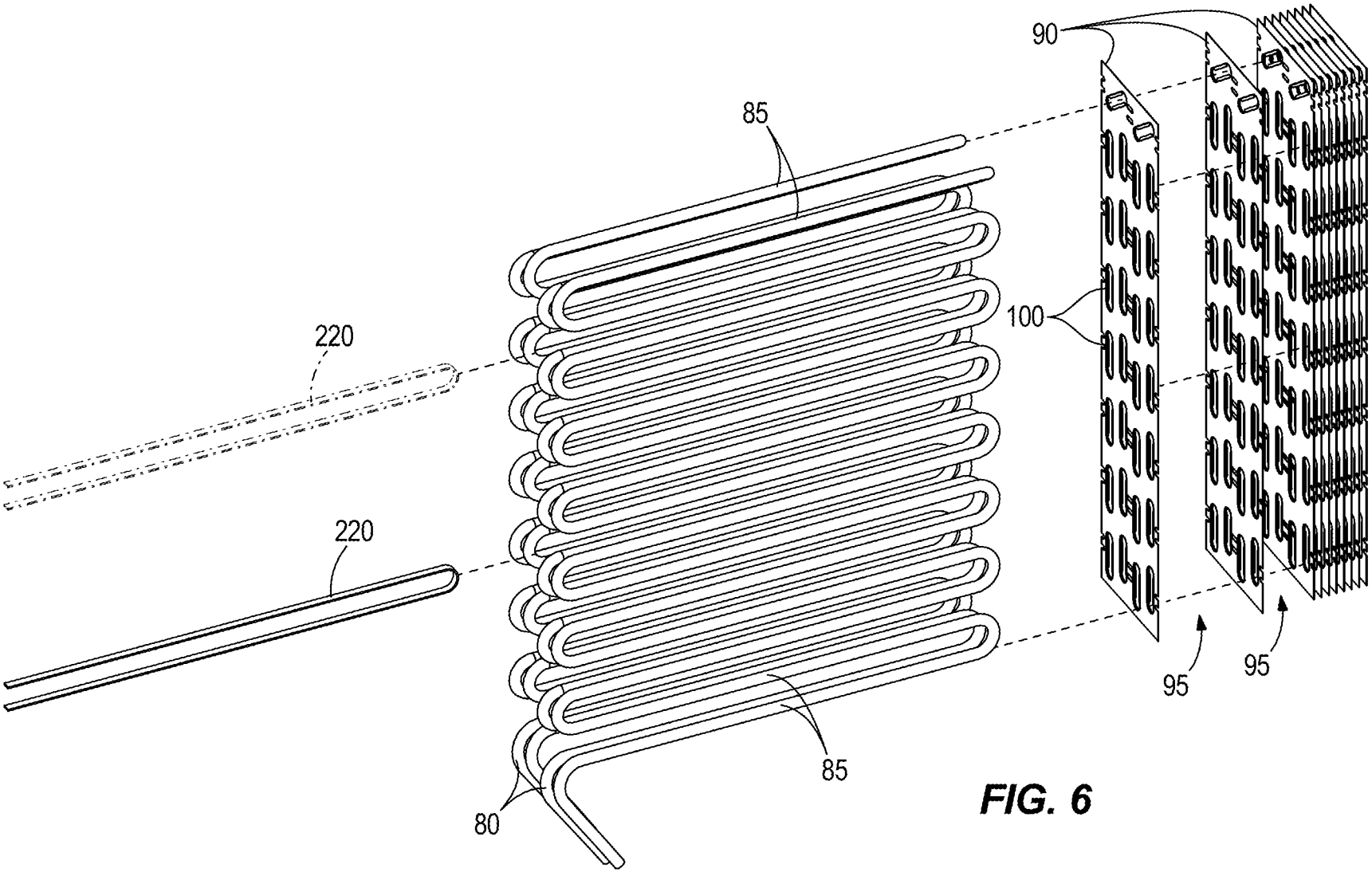
FIG. 6 is an exploded perspective view of the evaporator of FIG. 5 illustrating the coils, the fins, and the heater insert of FIG. 5.
Figure 7:
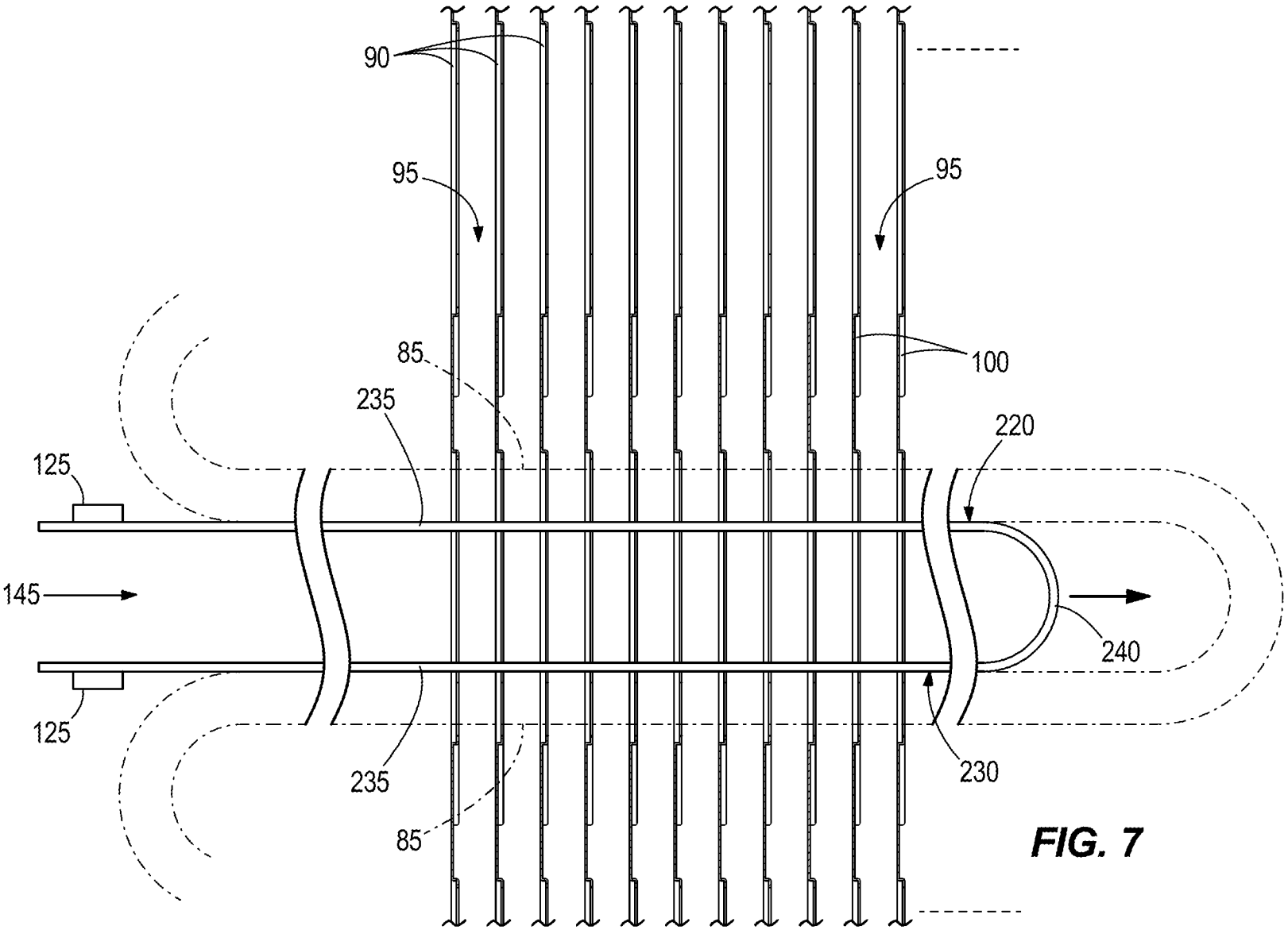
FIG. 7 is a side view of a portion of the evaporator of FIGS. 5 and 6 illustrating the relationship between the heater insert and the fins.
Figure 9:
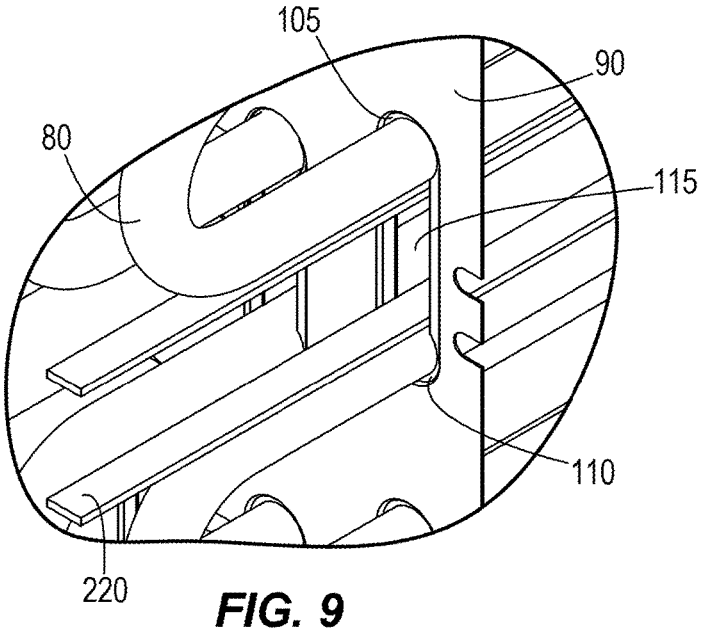
FIG. 9 is an enlarged view of the slots in FIG. 8 illustrating the coils and an exemplary heater insert.

FIGS. 5-7 illustrate another exemplary heater insert 220 that can be coupled to the coils 80 to defrost the evaporator 75 (alone or in combination with one or more heater inserts 120). As illustrated in FIGS. 6 and 7, the heater insert 220 includes a flexible or resilient elongated body 230 with planar extension portions 235 that are connected by a curved end or bridge 240 (e.g., forming a U-shaped body 230). The heater insert 220 is disposed within axially-aligned slots 100 and extends parallel to the tube sections 85. The heater insert 220 can span the full length of the evaporator 75 or less than the full length.

Referring to FIGS. 6, 7, 9, and 10, the heater insert 220 can be installed in or coupled to the evaporator 75 before or after the evaporator 75 is fully assembled (e.g., during or after assembly). The elongated body 230 is inserted into the space between the tube sections 85 that are disposed in the axially-aligned tube slots 100. The extension portions 235 can resiliently flex toward and a way from each other, if desired, so that the heater insert 120 can more easily fit through the slots 100 between the tube sections 85. Due to the planar nature of the extension portions 235 and the smooth tube surfaces, insertion of the heater insert 220 into the evaporator 75 does not require the 'walk-through' assembly process associated with the heater insert 120. After insertion of the heater insert 120 through the slots 100, any bias applied to the extension portions 135 (along or across the axis 147) can be released so that the extension portions 135 can engage or contact the tube sections 85. Release of the bias returns the heater insert 120 to its original shape or close to the original shape.

It will be appreciated that more than one heater insert 220 can be installed within the evaporator 75, and that the heater inserts 220 can be connected to each other so that the inserts 220 can be slid into the evaporator 75 simultaneously. The heater insert(s) 220 can be removed (and replaced by another heater insert, if desired) by reversing the steps described above.

After the heater insert 120, 220 is position within the evaporator 75, the bias or resilience of the extension portions 135, 235 hold or retain the heater insert 120, 220 in place within the evaporator 75 without using adhesive or other fasteners. The illustrated heater insert 120, 220 can be resiliently biased against the coil 80, the fins 90, or both the coils 80 and the fins 90 to hold the heater insert 120, 220 in place. It will be appreciated that adhesive or another fastener can be used, if desired.

In operation, the heater insert 120, 220 is in direct contact with one or both of at least a portion of one or both of the tube sections 85 and the fins 90 to defrost the evaporator 75 by conduction and convection to increase the heat-transfer rate between the heater insert 120, 220 and the evaporator 75. By creating surface area contact with the fins 90, the heater insert 120, 220 can more quickly defrost the evaporator 75 by applying conductive heat to the fins while also facilitating convection and/or conductive defrost of the coils 80. Likewise, the heater insert 120, 220 can directly heat the coils 80 using conduction, while heating the fins 90 by convection and/or conduction.

The heater inserts 120, 220 can be placed throughout the evaporator 75 in a pattern that minimizes heat waste and pinpoints or focuses heat in the areas most susceptible to frost conditions. For example, the heater insert 120, 220 can be positioned closer to the air outlet of the evaporator relative to the air inlet where frost accumulation is likely to occur. Also, the heater insert 120 can include a greater quantity of pleats 150 formed on one side to respond to a higher accumulation of frost on that side. Different types of heater inserts can be used in combination within a single evaporator 75 to most effectively defrost the evaporator 75. The pattern of the heater inserts 120, 220 can take any form based at least in part on the defrost profile for the evaporator 75. After the optimal heater insert pattern is determined and implemented, power can be applied to one or more of the heater inserts 120, 220 via the electrical connections 125.

Various features and advantages of the invention are set forth in the following claims.

The invention claimed is:

1. A heat exchanger comprising:

fins spaced apart from each other, each of the fins including one or more tube slots;

a coil coupled to the fins and including a tube section extending through axially aligned tube slots; and a heater insert extending through one or more of the axially aligned tube slots adjacent an exterior of the tube section to defrost the heat exchanger.

2. The heat exchanger of claim 1, wherein the heater insert is defined by a U-shaped body coupled to the fins such that the U-shaped body is aligned with an airflow direction associated with the fins.

3. The heat exchanger of claim 1, wherein the heater insert contacts one or more of the fins.

4. The heat exchanger of claim 1, wherein the heater insert contacts the tube section.

5. The heat exchanger of claim 1, wherein the heater insert includes pleats disposed along a length of the heater insert, and wherein the pleats are disposed between adjacent fins upon full insertion of the heater insert into the axially aligned tube slots.

6. The heat exchanger of claim 5, wherein the pleats are resiliently biased into contact with the adjacent fins.

7. The heat exchanger of claim 1, wherein the heater insert includes carbon fiber material.

8. The heat exchanger of claim 1, wherein the coil defines a serpentine arrangement having two tube sections extending through each of the axially aligned tube slots, and wherein the heater insert is disposed between the two tube sections.

9. The heat exchanger of claim 1, wherein the fins are arranged to define an airflow path through the heat exchanger, wherein the heater insert is a first heater insert and the heat exchanger includes a second heater insert, and wherein the first heater insert and the second heater insert are coupled to the fins in a location closer to an airflow outlet than an airflow inlet of the heat exchanger.

10. The heat exchanger of claim 1, wherein the coil defines a serpentine arrangement having two tube sections extending through each of the axially aligned tube slots, and wherein the heater insert is disposed between the two tube sections.

11. A heat exchanger comprising:

fins spaced apart from each other, each of the fins including one or more tube slots;

a coil coupled to the fins and including a tube section extending through axially aligned tube slots; and a heater insert including an elongated body extending through the axially aligned tube slots and in contact with one or both of the fins and an exterior surface of the tube section to conductively heat the one or both of the fins and the exterior surface.

12. The heat exchanger of claim 11, wherein the heater insert includes a plurality of pleats disposed along a length of the heater insert, and wherein the pleats are disposed between adjacent fins upon full insertion of the heater insert into the heat exchanger.

13. The heater exchanger of claim 12, wherein the elongated body has opposite extension portions and a bridge connecting the extension portions, and wherein at least one of the extension portions defines the pleats.

14. The heater exchanger of claim 13, wherein the extension portions resiliently flex along an axis along which the body is elongated, and wherein at least one of the extension portions further resiliently flexes toward and away from the axis.

15. The heat exchanger of claim 11, wherein the heater insert is oriented in the aligned tube slots such that a gap between extension portions is aligned with an airflow direction associated with the fins.

* * * * *